US007152523B2

(12) United States Patent
Kobayashi et al.

(10) Patent No.: US 7,152,523 B2
(45) Date of Patent: Dec. 26, 2006

(54) PRESS MACHINE

(75) Inventors: Kijuro Kobayashi, Machida (JP); Nobuyoshi Maeda, Kanagawa-ken (JP); Takashi Kawahara, Sagamihara (JP)

(73) Assignee: Aida Engineering Co., Ltd., Kanagawa (JP)

( * ) Notice: Subject to any disclaimer, the term of this patent is extended or adjusted under 35 U.S.C. 154(b) by 919 days.

(21) Appl. No.: 09/888,073

(22) Filed: Jun. 22, 2001

(65) Prior Publication Data

US 2002/0011156 A1 Jan. 31, 2002

(30) Foreign Application Priority Data

Jun. 26, 2000 (JP) ..... 2000-190871

(51) Int. Cl.
*B30B 5/00* (2006.01)

(52) U.S. Cl. ..... 100/245; 100/257
(58) Field of Classification Search ..... 100/245, 100/257
See application file for complete search history.

(56) References Cited

U.S. PATENT DOCUMENTS

| | | | | | |
|---|---|---|---|---|---|
| 2,384,160 | A | * | 9/1945 | Ernst | 72/456 |
| 3,572,137 | A | | 3/1971 | Nakano | 74/44 |
| 3,869,927 | A | | 3/1975 | Lose et al. | 74/44 |
| 4,161,342 | A | | 7/1979 | Nelsen | 308/6 R |
| 5,218,901 | A | * | 6/1993 | Imanishi | 100/53 |
| 5,852,970 | A | * | 12/1998 | Bornhorst et al. | 100/53 |
| 5,915,296 | A | * | 6/1999 | Itakura | 100/209 |
| 6,012,322 | A | * | 1/2000 | Itakura | 72/450 |

FOREIGN PATENT DOCUMENTS

| | | |
|---|---|---|
| DE | 2218438 | 10/1973 |
| EP | 0 505 026 A2 | 9/1992 |
| EP | 0 955 155 A1 | 11/1999 |
| GB | 606871 A | 8/1948 |
| GB | 617471 A | 2/1949 |
| GB | 617764 A | 2/1949 |
| GB | 1039552 A | 8/1966 |
| GB | 2168914 | 7/1986 |
| JP | 63 010099 | 1/1988 |
| JP | 09 010998 | 1/1997 |
| JP | 09 295191 | 11/1997 |

* cited by examiner

*Primary Examiner*—Dennis H. Banks
*Assistant Examiner*—Shelley Self
(74) *Attorney, Agent, or Firm*—Darby & Darby

(57) ABSTRACT

A drive mechanism drives a slide in a cycle along a centerline. The slide includes a press center symmetrical with a frame centerline. A frame includes guides aligned with the press center and the slide to eliminate rotative force upon the slide during operation and increase precision. The drive mechanism includes a first and a second link coupling a main gear to a crank shaft to lower a slide speed near a bottom dead center position and increase a slide speed near a top dead center thereby increasing a press force at the bottom dead center position and speeding cycle turn.

7 Claims, 7 Drawing Sheets

PRESS MACHINE

BACKGROUND OF THE INVENTION

1. Field of the Invention

The present invention relates to a press machine equipped with a flywheel. More specifically, the present invention relates to a press machine including a press center aligned with guide members which minimizes rotational force on the press and increases pressing precision and force during operation.

2. Description of the Related Art

Referring now to FIGS. 4(A) and 4(B), a conventional press 101 includes a frame 102 having a 'C-type' frame or structure. It should be understood that conventional presses, known as one-point presses, typically include this 'C-frame' type of structure. C-frame structures have stress and accuracy disadvantages that adversely affect quality and cost, later described.

A pair of individual guides 103 are at a left and right side of frame 102. During operation, a slide 104 operates between guides 103. Guides 103 act to guide and support slide 104 and allow slide 104 to raise up and down in operation while maintaining approximate alignment, as will be explained.

A bolster 108 is on frame 102 at a position facing slide 104. A die 107 is positioned between slide 104 and bolster 108.

A flywheel 111 is in conventional press 101. Flywheel 111 is equipped internally with a clutch/brake mechanism (not shown) that aid operation. A motor 105 rotates flywheel 111. A drive shaft 112 is rotatably disposed on frame 102. Flywheel 111 is on one end of drive shaft 112. A set of gears 112*a* are on drive shaft 112.

A crank shaft 113 is rotatably attached at the top of frame 102. Crank shaft 113 includes an eccentric section 113*a*. A connecting rod 106 connects to eccentric section 113*a* of shaft 113.

Crank shaft 113 connects to slide 104 through connecting rod 106. A main gear 114 is fixed to an end of crank shaft 113. Main gear 114 operably meshes with and engages gears 112*a*.

A drive mechanism 110 includes crank shaft 113, main gear 114, drive shaft 112, and flywheel 111.

Now referring additionally now to FIG. 5, guide 103 is positioned behind a press center P and symmetrically to the left and right of press center P. Press center P is positioned away from guide 103.

During operation, press center P is the center of pressing operation and pressing force on slide 104.

It should be understood, that since press center P and guide 103 are not aligned along the direction of force, the position results in undesirable rotational force placed upon guide 103 during pressing operation.

During operation, slide 104 presses against die 107 and exerts force through press center P. Since press center P and guides 103 are not aligned, slide 104 transmits the force vector into a rotational force upon guides 103.

A pair of slide-side gibs 104*a* are at the left and right side of slide 104. A front liner 103*a*, a side liner 103*b*, and a rear liner 103*c* support slide-side gib 104*a* during operation.

During operation, a drive force of motor 105 causes flywheel 111 to rotate. Drive shaft 112 rotates when the clutch in the clutch/break mechanism (not shown), mounted in flywheel 111, connects. Drive shaft 112 rotates main gear 114. Main gear 114 rotates crank shaft 113. Connecting rod 106 on eccentric portion 113*a* causes slide 104 to operate.

In conventional press 101, the sliding sections of drive mechanism 110 and guide 103 are lubricated with grease.

It is to be understood that during operation of conventional press 101, with the C-shaped frame 102, an undesirable problem called "frame gap opening" or simply 'gapping' occurs. Frame gap opening occurs when an opening of frame 102 is opened as a result of a pressing operation and slide 104 receiving pressing forces.

Additionally, a set of corners R1, R2, and R3 on frame 102 experience particularly high stress during pressing operation of conventional press 101. Additionally, damage to frame 102 may result at corners R1, R2, or R3, during severe pressing operation, and cause failure of frame 102 or failure to operate press 101. This type of frame damage is very expensive and time consuming to remedy.

A third problem may result during operation of conventional press 101. Frame gap opening may additionally cause slide 104 to tilt relative to conventional press 101. Where slide 104 tilts, this adversely affects levelness in relation to bolster 108, die 107, and may cause slide 104 to fail.

Fourth, die 107 may tilt due to the adverse effects of the "gaping" problem. Where die 107 tilts, the life span of a die and die equipment may be reduced. Further, when die 107 tilts, the precision of conventional press 101 is reduced thus increasing quality rejects and increasing costs.

It is to be further understood, that "frame gap opening" or "gaping" can cause "breakthroughs" in stamping operations, ruining the stamped item, reducing quality, increasing costs, increasing noise, and increasing vibration.

Various solutions have been proposed to prevent the "gaping," tilting, and breakthrough problems associated caused by the construction of conventional presses 101. These conventional solutions have focused on increasing the thickness of the side plates of frame 102 and placing a separate structurally supportive bridge across the conventional press 101 opening.

These representative solutions adversely increase the size, weight, and cost of conventional press 101 and are thus undesirable. The negative results to the conventional fixes for the above problems adversely affect users of conventional press 101 and make simple and quick operation difficult.

It is to be understood that in conventional press 101, the use of separate parts in frame 102 in and of itself, increases the above described 'gapping', tilting and associated problems. These separate parts have varying thicknesses to compensate for the stress placed on each part during operation. Further, the mechanical connectors, i.e., bolts, between the multiple frame parts are subject to failure, and the connectors act as stress concentrators, the use of mechanical connectors further increases the above described problems.

It is to be understood that in conventional press 101, grease is used as a lubricant on the various sliding sections and drive mechanism. The use of grease makes it difficult to maintain precision operations, provide low clearance at sliding sections for levelness, and maintain operational cleanliness thus reducing quality.

OBJECTS AND SUMMARY OF THE INVENTION

It is an object of the present invention to provide a press machine operating a slide in a cycle with increased precision and force.

It is another object of the present invention to provide a press with increased pressing precision, a light and compact frame structure, increased operational life, increased structural rigidity, and uniform frame expansion.

It is another object of the present invention to provide a press where a slide speed is slowed near a bottom dead center position and increased near a top dead center position thereby increasing a pressing force and maintaining efficiency.

It is another object of the present invention to provide a press equipped with a flywheel wherein rotational energy of the flywheel raises and lowers a slide by way of a drive mechanism to process a raw material using a die disposed on the slide.

It is another object of the present invention to provide a press machine frame being continuously and integrally formed and having substantially identical cross-sectional areas about a centerline and a press center.

It is another object of the present invention to provide a press machine with a frame and slide mechanism that eliminates rotational force upon the frame during operation and thereby eliminates rotational gapping problems common in the industry.

It is another object of the present invention to provide a press machine with a frame and a slide where the slide maintains a level orientation during operation and increases pressing precision and reduces wear.

It is another object of the present invention to provide a press machine where the slide impact from processing a raw material can be restricted and minimized thereby lowering noise and increase a die life-span.

It is another object of the present invention to provide a press machine where sliding sections of the press machine are provided with a forced-circulation oil lubrication thereby eliminating grease lubrication and reducing required sliding clearance and increasing precision.

Briefly stated, the present invention relates to a press machine including a drive mechanism that drives a slide in a cycle along a centerline. The slide includes a press center symmetrical with a frame centerline. A frame includes guides aligned with the press center and the slide to eliminate rotative force upon the slide during operation and increase precision. The drive mechanism includes a first and a second link coupling a main gear to a crank shaft to lower a slide speed near a bottom dead center position and increases a slide speed near a top dead center thereby increasing a press force at the bottom dead center position.

According to an embodiment of the present invention there is provided, a press machine, comprising: drive means for permitting operation of a slide in a cycle, a press center on the slide, a first and a second guide member on the press machine parallel to the press center, the first and the second guide members and the press center aligned on a common centerline, and the slide receiving a driving force from the drive means and the first and the second guide members guiding the slide in the cycle along the common centerline and eliminating a rotational force upon the slide during the operation, thereby increasing press machine precision, operational life, and rigidity.

According to an embodiment of the present invention there is provided, a press machine, further comprising: a frame supporting the drive means and the slide, the frame having a shape symmetrical and continuous about the press center, a crank shaft in the drive means, a main gear in the drive means receives the driving drive force, the main gear eccentric to the crank shaft, a first link extending rigidly perpendicular from the crank shaft, and a second link rotatably couples the first link to the main gear and transmits the drive force from the main gear to the crank shaft whereby the slide operates in the cycle.

According to an embodiment of the present invention there is provided, a press machine, further comprising: a top and a bottom dead center position on the slide, the main gear having a rotation angle ($\theta$), the crank shaft having a rotation angle ($\theta''$), an inner angle ($\theta'$) defined between the first and the second link, the inner angle ($\theta'$) at a maximum when the slide is at the bottom dead center, the inner angle ($\theta'$) at a minimum when the slide is at the top dead center, and the rotation angle ($\theta$) distributed between the inner angle ($\theta'$) and the rotation angle ($\theta''$) whereby the drive means distributes a slide speed during the cycle and slows the slide the bottom dead center position relative to the top dead center position and increases a pressing force at the bottom dead center position.

According to an embodiment of the present invention there is provided, a press machine, further comprising: at least a first and a second side of the slide, the first and second sides operable between each respective the first and second guide members, at least a first and a second slide side gib, each the first and second slide side gib on each respective the first and the second side of the slide, at least a first, a second, and a third mating surface on each respective the first and second slide side gib, at least a front, a side, and a rear liner on each respective the first and second guide members, and each the front, side, and rear liner in guiding contact with each respective the first, second, and third mating surface whereby the slide operates vertically along the common centerline and the press center and prevents the rotational force.

According to another embodiment of the present invention there is provided a press machine, comprising: a frame, a flywheel, a drive mechanism, and a slide in the frame, the slide operating along a first centerline of the frame, a press center on the slide, the press center aligned with the first centerline and the frame, the drive mechanism operating the slide along the press center, the slide and the frame symmetrical about the press center and the first centerline, and the frame being continuous and symmetrical about the first centerline whereby the frame resists a rotational force during a pressing operation and eliminates an operational gapping risk.

According to an embodiment of the present invention there is provided, a press machine, further comprising: a first and a second side member in the frame, the first and second side members opposite a second centerline of the frame, a crown member in the frame joining the first and second side members, a drive mechanism holding section in the frame, the crown member and a drive mechanism holding section supporting the drive mechanism, a bed member, and the bed member connecting the first and second side members below the slide whereby the first and the second side member rigidly joined and the frame is increased in strength and rigidity thereby minimizing an operational gapping and increasing a pressing precision.

According to an embodiment of the present invention there is provided, a press machine, further comprising: at least a first and a second guide members in the frame, each the first and second guide members disposed symmetrical about the press center and the first centerline, each the first and the second members supporting the slide, at least a first liner member in each the first and second members, at least a first and a second slide side gib in the slide, each the first and second slide side gib in guiding contact with each the first liner on each respective the first and second members, and the first and second members and each the first liner engaging the slide and allowing the slide to operate in the press machine, whereby operational gapping is prevented and the pressing precision is improved.

According to an embodiment of the present invention there is provided, a press machine, further comprising: a drive shaft in the drive mechanism, the slide having a top and a bottom dead center position, the drive shaft rotatably disposed on the frame, a gear section on the drive shaft operable joined to the flywheel, a main gear rotatably disposed on the frame, the main gear meshing with the gear section, a crank shaft rotatably disposed on the frame, an eccentric section on the crank shaft, a connecting rod operably coupling the crank shaft to the slide, a first link fixed to a first end of the crank shaft, the first link perpendicular to the crank shaft, a second link operably connecting the first link to the main gear, a first angle operably defined between the first and second link whereby the first angle is at a maximum at the bottom dead center position and at a minimum at the top dead center position, and a rotation axis of the main gear and a rotation axis of the crank shaft are eccentric along a common center line, whereby a speed of the slide is at a minimum at the bottom dead center and a maximum at the top dead center position thereby increasing a pressing force at the bottom dead center position.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1A:
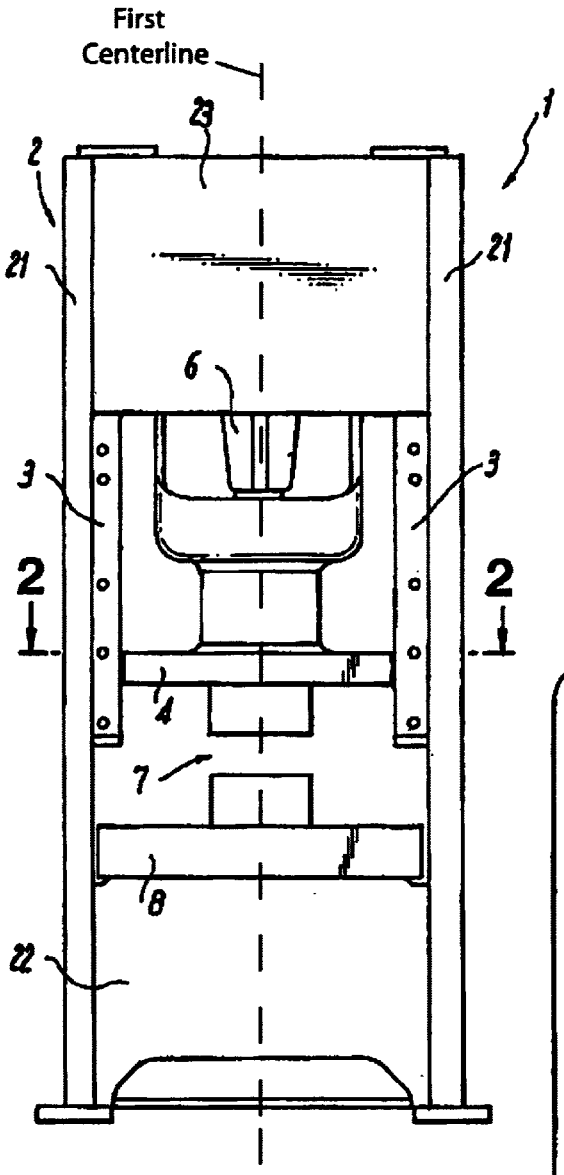
FIG. 1(A) is a front-view of a press according to the present invention.
Figure 1B:
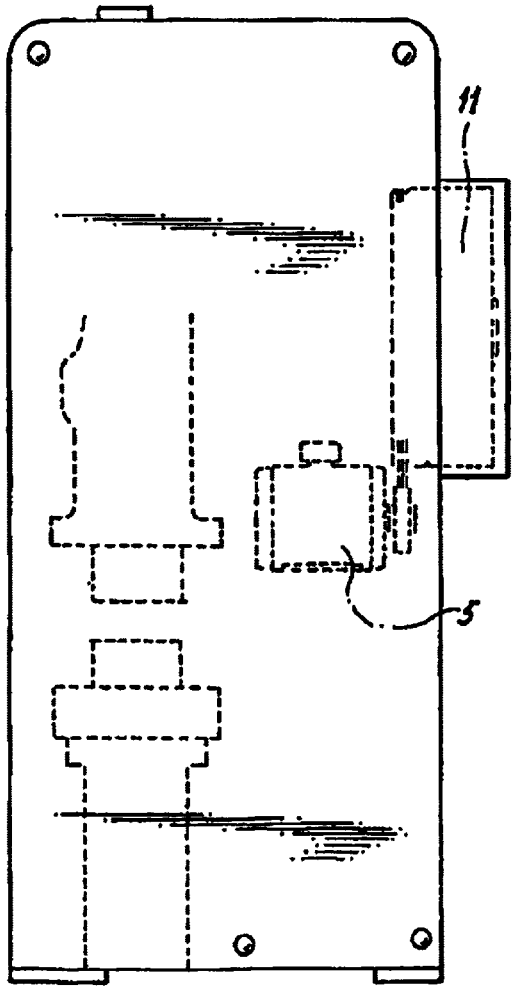
FIG. 1(B) is a side-view of a press according to the present invention.

Referring now to FIGS. 1(A) and 1(B), describing a press 1 including a frame 2 integrally formed in a single continuous main structural piece. A pair of plate members 21, 21 are defined in frame 2. Plate members 21, 21 face each other along a common centerline on frame 2. A slide 4 is positioned, and securely operates, between plate members 21, 21 of frame 2, as will be described. Plate members 21, 21 are on each side of slide 4. Plate members 21, 21, while being integral, each include additional opposing sections having different thicknesses formed to provide support press 1 and resist the above concerns.

A guide 3 is integrally formed in frame 2. Guide 3 supports each side of slide 4. Guide 3 allows slide 4 to operate in a guided up-and-down manner. A bolster 8 is below slide 4. A bed 22 supports bolster 8 below slide 4. A die 7 is between slider 4 and bolster 8, and plate members 21, 21. In operation, a connecting rod 6 drives die 7 and slide 4, as will be explained.

A crown 23 is integrally formed in a top section of press 1 between plate members 21, 21.

A flywheel 11 is in press 1. A motor 5 drives flywheel 11 and allows flywheel 11 to operate press 1, as will be explained.

Figure 2:
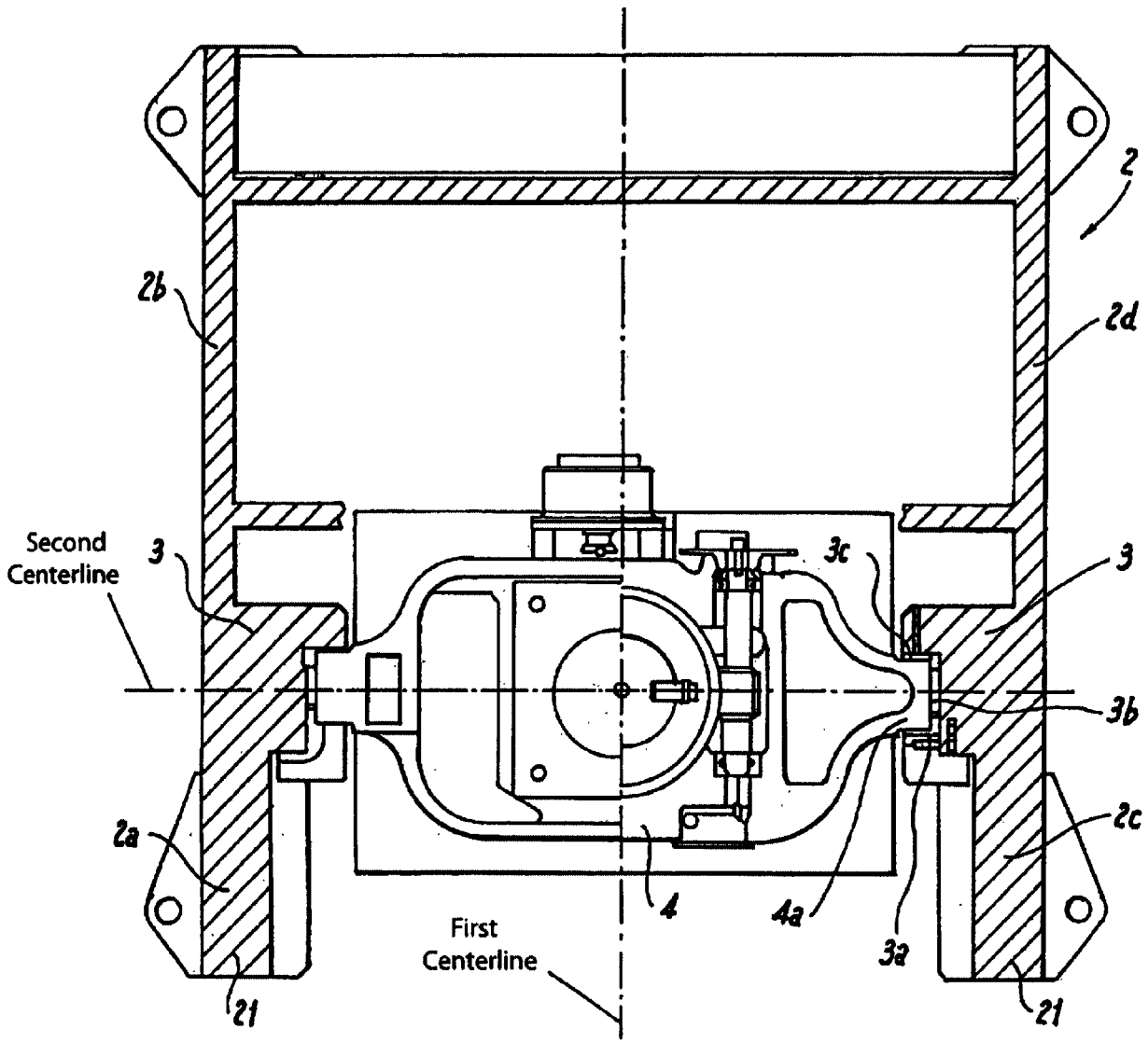
FIG. 2 is a partial cross-section drawing along line 2—2 in FIG. 1(A).

Additionally referring now to FIG. 2, frame 2 and plate members 21, 21 include integral cross-sections 2*a*, 2*b*, 2*c*, and 2*d*. Cross-sections 2*a*, 2*b*, 2*c*, and 2*d*, each have different thicknesses on plate members 21, 21. Guides 3 include a front liners 3*a*, side liners 3*b* and rear liners 3*c*. Slide 4 operates between guides 3 and does not extend beyond the plate members 21.

A press center P is centered in die 7 and slide 4. Press center P is centered between each side of guide 3 and symmetrical to a centerline of press 1. During operation, press center P receives a press load. Since guide 3 is positioned generally symmetrically to the front, back, left, and right sides of press center P (as shown) the press load is evenly distributed through slide 4 to each side of guide 3. Since the press load is evenly distributed to guide 3, there is no rotational force placed upon guide 3, thereby preventing deformation and operational concerns, as will be explained.

A slide-side gib 4*a* is on each side of slide 4 opposite press center P. Slide-side gibs 4*a* are supported on three sides (three mating surfaces (first, second, and third mating surfaces) as shown) by respective front liners 3*a*, side liners 3*b*, and rear liners 3*c* attached in respective guides 3. Front liners 3*a*, side liners 3*b*, and rear liners 3*c* accurately guide slide 4 along guide 3 during operation and maintain alignment with press center P and frame 2. Front liners 3*a*, side liners 3*b*, and rear liners 3*c* are symmetrically disposed, to the respective front, side, and rear of press center P.

Cross sections 2*a*, 2*b*, 2*c*, and 2*d* of frame 2 are symmetrical to press center P. Cross sections 2*a*, 2*b*, 2*c*, and 2*d* are symmetrical to a first center line (vertical centerline of press 1) and symmetrical to a second center line (horizontal centerline of press 1), both shown on FIG. 2. During operation, press 1 may expand or contract due to operational and environmental pressures. Since cross sections 2*a*, 2*b*, 2*c*, and 2*d* are symmetrical to press center P any expansion during operation forced to be uniform along a front-back axis and left-right axis to press center P. It is to be understood, that controlling the effects of expansion, minimizes the possibility of operational errors and press 1 failure. It is to be understood that the effects of operational expansion are beneficially managed through a combination of frame integral construction, frame symmetry, alignment of press center P, slide 4 (with slide-side gibes 4*a*), and guide 3 in press 1 and other construction details indicated above and below.

Figure 3A:
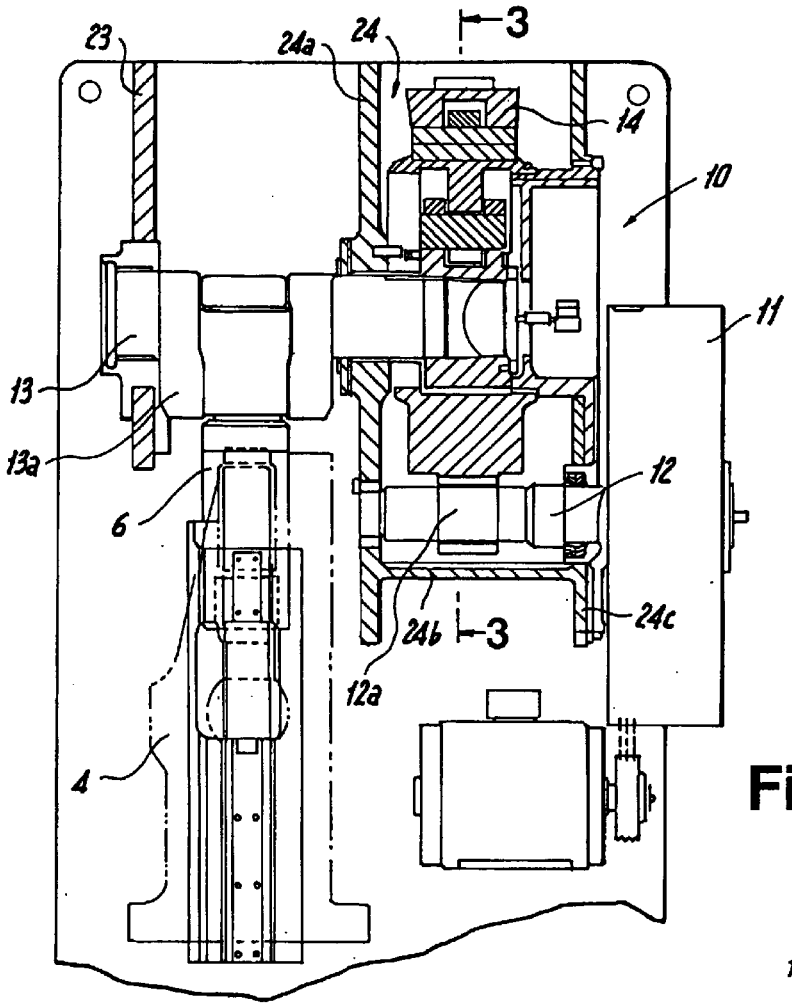
FIG. 3(A) is a detailed side-view of a drive mechanism according to the present invention.
Figure 3B:
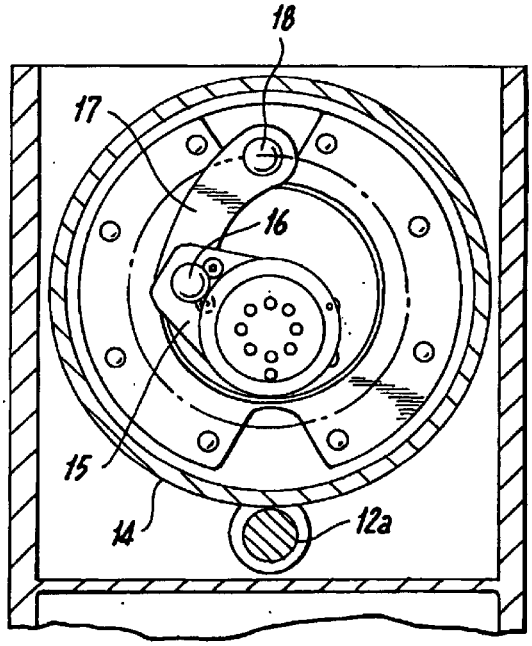
FIG. 3(B) is a cross-section drawing along the 3—3 line in FIG. 3(A).

Additionally referring now to FIGS. 3(A) and 3(B), a drive mechanism holding section 24 extends between plate members 21, 21. A drive mechanism 10 is integral with press 1, as will be explained. Drive mechanism 10 is incorporated in drive mechanism holding section 24.

Drive mechanism holding section 24 includes integral sections 24*a*, 24*b*, and 24*c*, as will be explained, which further serve to strengthen press 1.

During operation, the rotational energy of flywheel 11 causes drive mechanism 10 to operate connecting rod 6 and drive slide 4 and die 7. A clutch/break mechanism (not shown) is mounted internally in flywheel 11.

A drive shaft 12 is rotatively disposed in frame 2. Gears 12*a* are on drive shaft 12. Flywheel 11 is on one end of drive shaft 12. Flywheel 11 is attached to drive shaft 12 through a clutch/break mechanism (not shown).

A main gear 14 is rotatably mounted on frame 2. Main gear 14 meshes with gear 12*a*. A crank shaft 13 is near the top of frame 2 above a center of fly wheel 11. An eccentric section 13*a* is on crank shaft 13. Eccentric section 13*a* connects to a large end of connecting rod 6. Crank shaft 13 connects to slide 4 through connecting rod 6.

It is to be understood, that the rotation axis of crank shaft 13 is eccentric to the rotation axis of main gear 14.

A first link 15 is fixed to one end of crank shaft 13 and extends away from crank shaft 13. A second link 17 rotatably extends from first link 15. A first link pin 16 operably connects first link 15 with second link 17. A second link pin 18 operably connects second link 17 to main gear 14. As a result, crank shaft 13 connects to main gear 14.

It should be understood, that the solid lines in FIGS. 3(A) and 3(B) indicate slide 4, first link 15 and second link 17 at a bottom dead center position. It should be further understood, that the dotted lines in FIG. 3(A) indicate slide 4 at a top dead center position.

During operation, the clutch in the clutch/break mechanism (not shown) is connected and the rotational (kinetic energy) of flywheel 11 transfers to drive shaft 12. The rotation of drive shaft 12 causes main gear 14 to rotate. Main gear 14 causes crank shaft 13 to rotate through operation of first link 15 and second link 17. The rotation of crank shaft 13 and eccentric section 13*a* causes connecting rod 6 to operate and raise and lower slide 4.

It should be understood that because the rotation axis of main gear 14 is eccentric to the rotation axis of crank shaft 13, in operation, slide 4 operates at a slow speed near the bottom dead center position, and at a higher speed in other positions. Thus, since the rotation axes of main gear 14 and crank shaft 13 are eccentric, through the operation of first link 15 and second link 17, this results in the different operation speeds of slide 4 through an operational cycle.

Additionally, since first link 15 operably joins to second link 17, they both act to transfer and increase the mechanical advantage of main gear 14 to crank shaft 13.

It is to be understood that a low speed near the bottom dead center position is greatly beneficial to increasing the pressing power and torque of press 1 at the bottom dead center position, and increasing slide speed near the other positions thereby making press 1 speedy in operation. Since slide 4 operates at low speed near the bottom dead center position this restricts the degree to which the impact generated affects press 1. This result additionally improves die life-span and reduces operational noise.

A center line exits (as shown) between the rotation center of crank shaft 13, main gear 14 of press 1. The difference between the center of crank shaft 13 and main gear 14 is a distance along the center line.

A rotation angle theta (θ) is formed (not shown) by main gear 14 during rotation relative to center line.

A rotation angle theta" (θ") is formed (not shown) by crank shaft 13 during rotation relative to the center line.

Figure 3C:
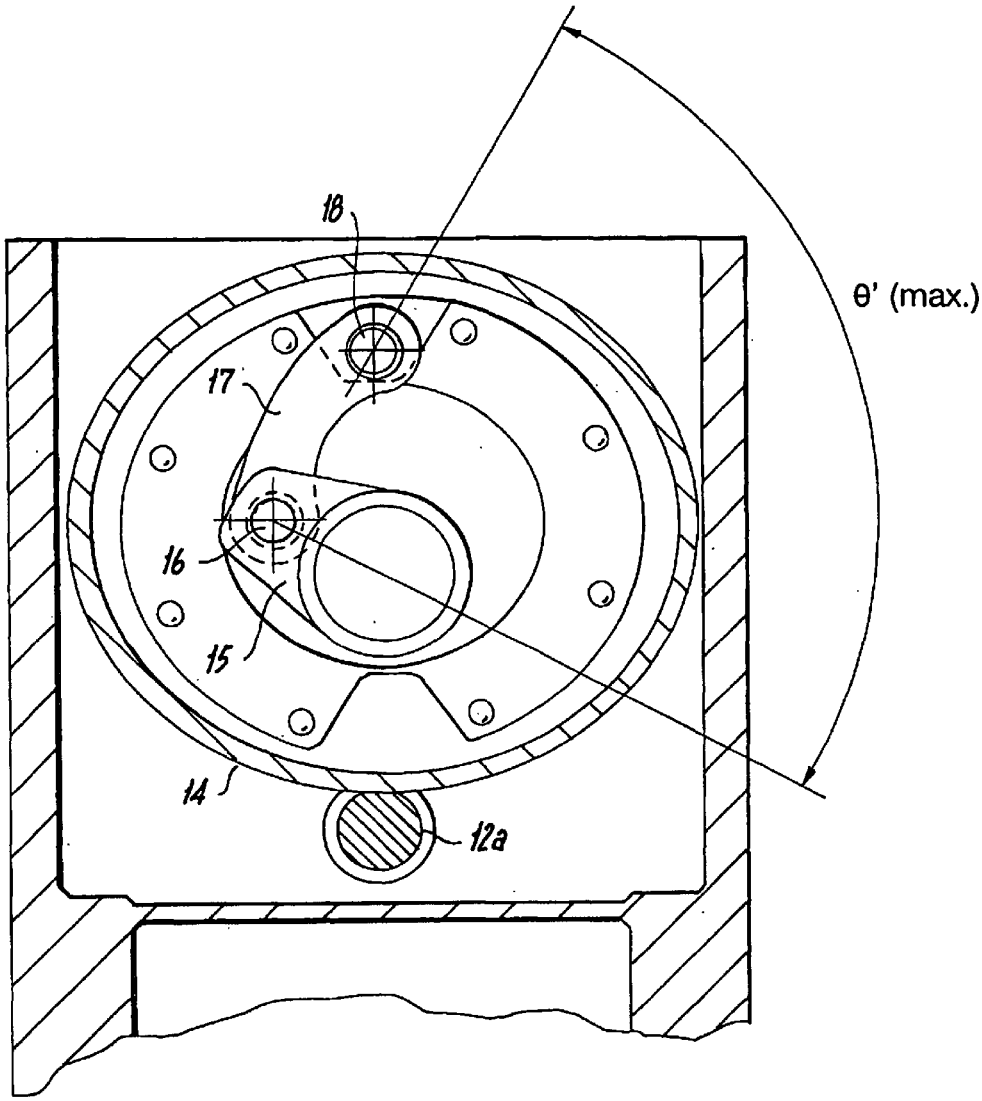
FIG. 3(C) is a cross-sectional drawing along the 3—3 line at a bottom dead center position.
Figure 3D:
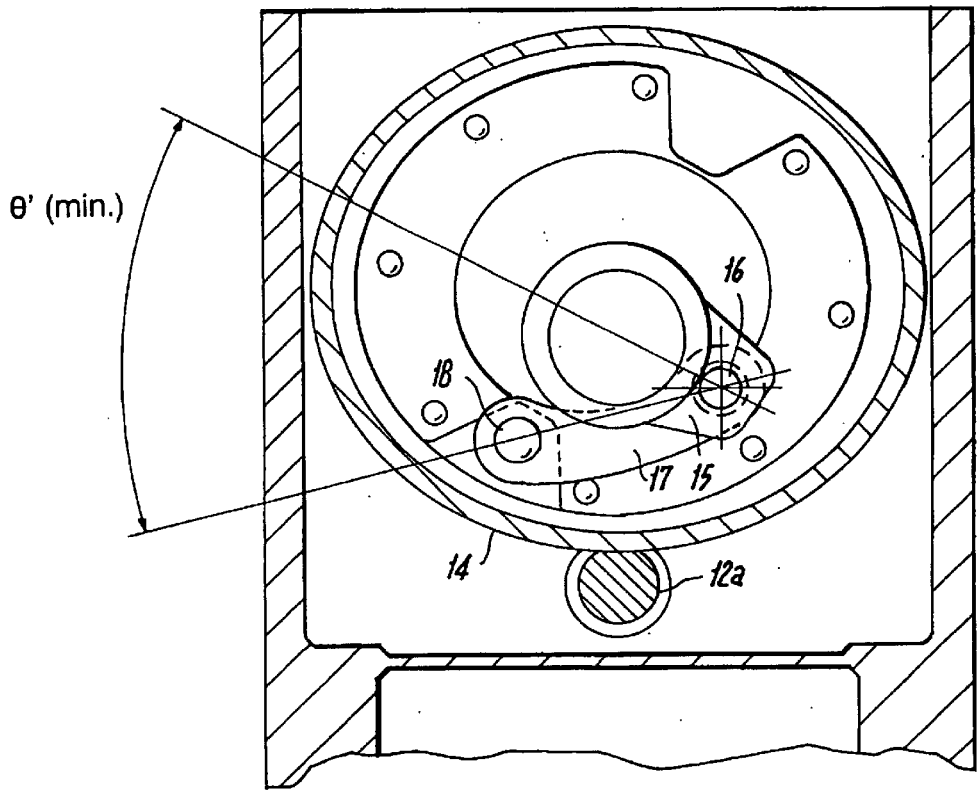
FIG. 3(D) is a cross-sectional drawing along the 3—3 line at the top dead center position.
Figure 4B:
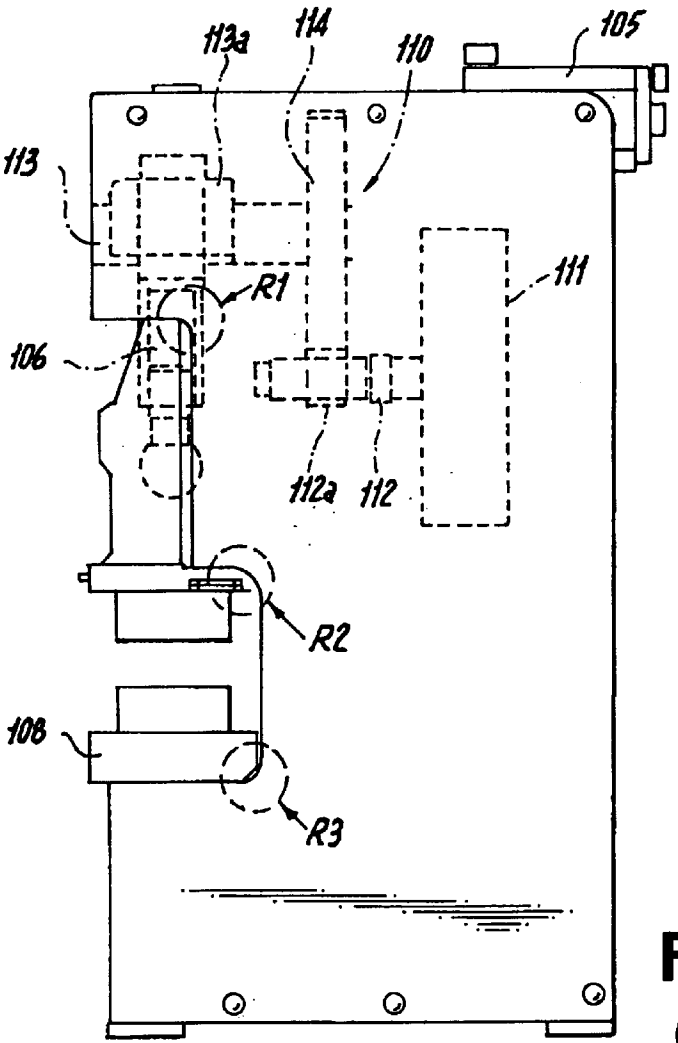
Fig. 4(B) (Prior Art)
FIG. 4(B) is a side-view of a conventional press.
Figure 4A:
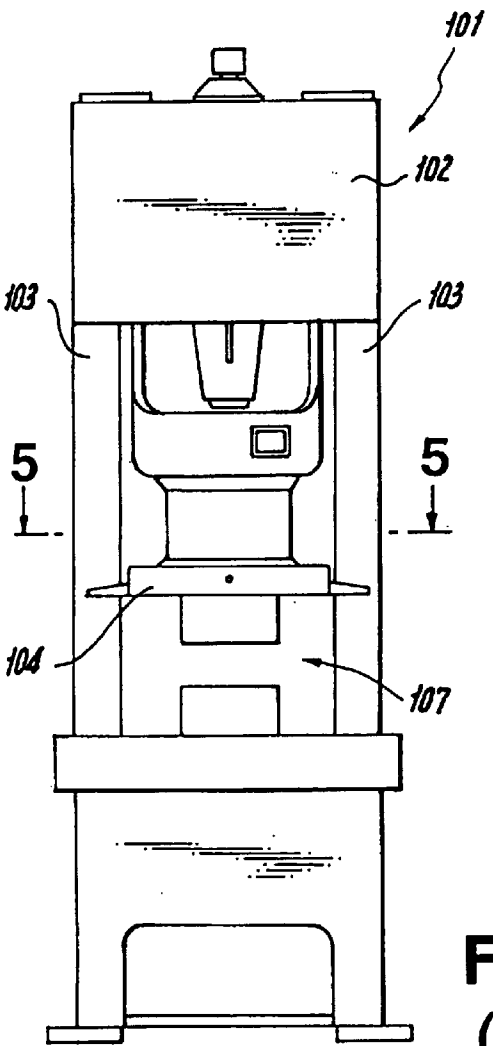
Fig. 4(A) (Prior Art)
FIG. 4(A) is a front-view of a conventional press.
Figure 5:
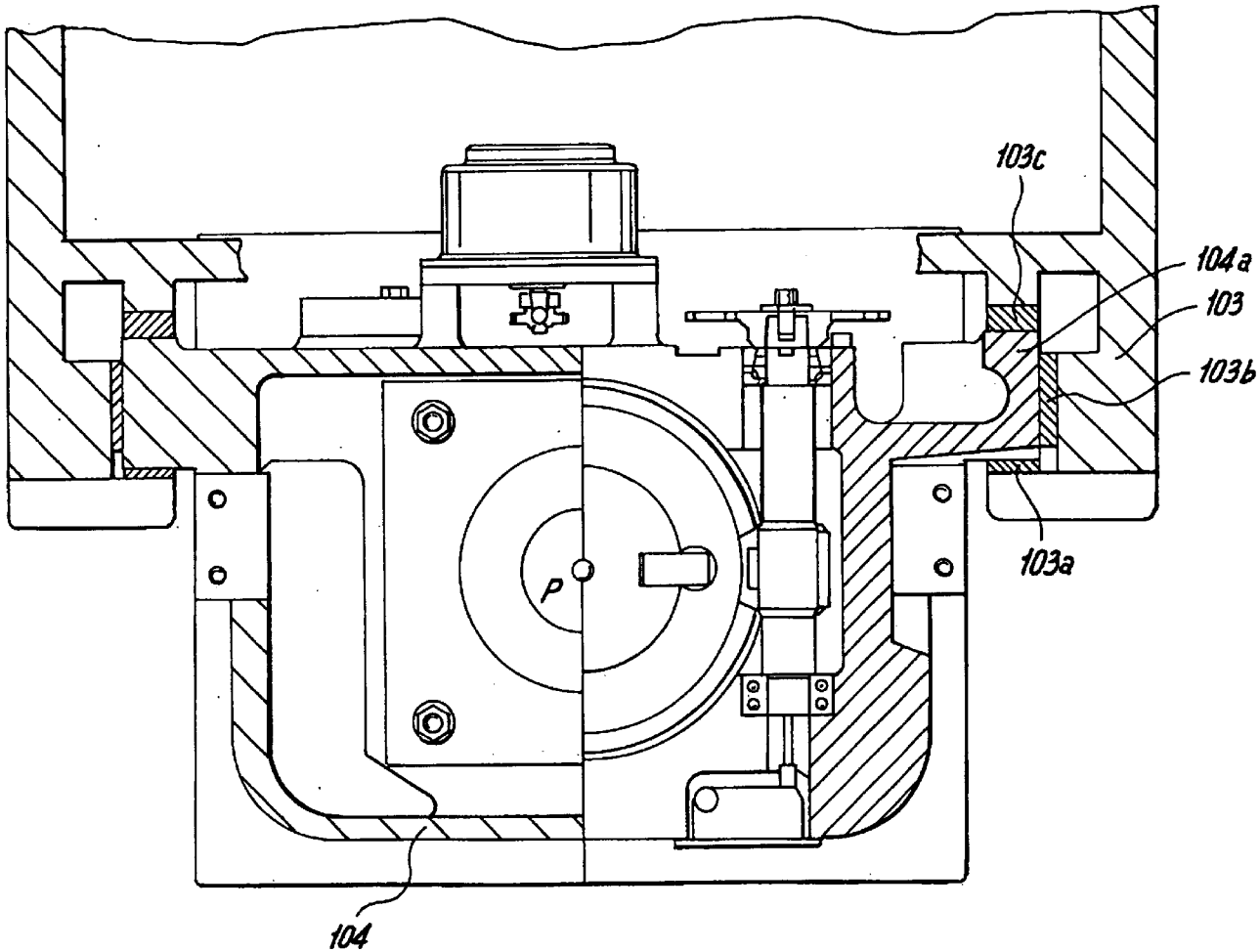
Fig. 5 (Prior Art)
FIG. 5 is a partial cross-section drawing along the 5—5 line in FIG. 4(A).

Additionally referring now to FIGS. 3(C) and 3(D), an inner angle theta' (θ') (a first angle) is defined between first link 15 and second link 17. Inner angle theta' (θ'), changes through the rotation of main gear 14 between an opening position at the bottom dead center position and a closing position at the top dead center position, as shown.

During operation, the eccentricity of the rotation axes of main gear 14 and crank shaft 13 causes rotation angle theta (θ), of main gear 14, to be distributed between the opening/closing of inner angle theta' (θ') and rotation angle theta" (θ") of crank shaft 13.

During operation, the bottom dead center position is reached when inner angle theta' (θ'), formed between first link 15 and second link 17, is at a maximum.

The top dead center position is reached when inner angle theta' (θ'), formed between first link 15 and second link 17, is at a minimum.

First link 15, second link 17 and main gear 14 operate to increase a torque transferred from main gear 14 to crank shaft 13 and slide 4.

It is to be understood, that clearance for the sliding sections of press 1 may be reduced by using lubricating oil. Specific sliding sections include the connection between the large end of connecting rod 6 and eccentric section 13*a* and between first link pin 16 and second link pin 18 and others. The ability to use oil and not grease, due to precision and design of press 1, results in additionally improved operational precision and cleanliness. Further, since the clearance of the sliding sections may be reduced by using oil, gapping concerns are eliminated.

Additional sliding areas may be the sliding sections of guide 3 between slide-side gibs 4*a*, and front liners 3*a*, side liners 3*b* and rear liners 3*c*.

It is to be understood, that according to the present invention, the cross-sectional areas of frame 2 relative to press center P are generally symmetrical across a central line. As a result, in operation the expansion of integrally formed frame 2 as a result of a press load is kept uniform to the front, back, left and right relative to press center P. As a result, 'gaping' is minimized and prevented without additional requirements, operation precision is improved, die life span is increased, and the precision of the pressed products is improved thereby removing breakthroughs.

It is to be understood, that since frame 2 is formed integrally, in a single piece with differing thicknesses, press 1 is more compact and lighter, while retaining rigidity, thus reducing production costs, maintaining precision, and eliminating flexing under press load. It should also be understood that the sides of frame 2 may be provided in a continues manner adjacent die 7 to provide additional rigidity and promote elimination of rotational forces.

It is to be understood, that according to precision allowed by the present invention slide 4 can be guided with improved accuracy thus increasing operational precision, and maintaining operational levelness.

It is to be understood, that since slide 4 operates at a slow speed near the bottom dead center position, the temporary slower speed reduces the adverse effect of slide 7, and prevents failure while maintaining press cycle time. It is to be understood, that the present invention, by maximizing precision and minimizing impact stress improves die 7 life span and allows pressing operations to be conducted with reduced noise.

It is to be understood, that due to the rigidity and design afforded by the above construction, the clearance of the sliding sections can be reduced, compared to cases where grease lubrication is used, thereby allowing oil lubrication and increasing precision.

It is to be understood, that the instant invention eliminates the need to design around the gapping problem by eliminating the gaping problem through a combination of novel position changes, design, reorienting elements, and controlling the speed of die at the bottom dead center position.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

Having described preferred embodiments of the invention with reference to the accompanying drawings, it is to be understood that the invention is not limited to those precise embodiments, and that various changes and modifications may be affected therein by one skilled in the art without departing from the scope or spirit of the invention as defined in the appended claims.

What is claimed is:

1. A press machine, comprising:

drive means for operating a slide in a cycle;

a press center on said slide;

a first and a second guide member on said press machine;

a line between said first and said second guide members passing through said press center;

said slide receiving a driving force from said drive means, and alignment said first and said second guide members with said press center eliminating rotational forces upon said slide and guiding said slide in said cycle along a common centerline, thereby increasing press machine precision, operational life, and rigidity;

a frame supporting said drive means and said slide;

said frame having a continuous shape symmetrical about said press center;

a crank shaft and a main gear in said drive means;

said main gear having a position eccentric about said crank shaft;

a first link extending perpendicular from said crank shaft;

a second link rotatably couples said first link to said main gear and increases and transmits said drive force from said main gear to said crank shaft whereby said slide operates in said cycle;

a top and a bottom dead center position on said slide;

said main gear rotatably disposed on said frame a gear section of said drive shaft operably joined to said main gear;

said crank shaft rotatably disposed on said frame;

an eccentric section on said crank shaft;

a connecting rod operably coupling said crank shaft to said slide;

a first angle operably defined between said first and second link whereby said first angle is at a maximum at said bottom dead center position and at a minimum at said top dead center position; and a rotation axis of said main gear and a rotation axis of said crank shaft are eccentric along a common center line, whereby a speed of said slide is at a minimum at said bottom dead center and a maximum at said top dead center position thereby increasing a pressing force at said bottom dead center position.

2. A press machine, according to claim 1, further comprising:

at least a first and a second side on said slide;

said first and second side operable between each respective said first and second guide members;

at least a first and a second slide side gib;

each said first and second slide side gib on respective said first and said second side of said slide;

at least a first, a second, and a third mating surface on each respective said first and said second slide side gibs;

at least a front, a side, and a rear liner on each respective said first and second guide members; and each said front, side, and rear liners in guiding contact with each respective said first, second, and third mating surfaces whereby said slide operates vertically along said common centerline and said press center and prevents said rotational force.

3. A press machine, comprising:

a frame;

a flywheel;

a drive mechanism;

a slide in said frame;

said slide operating along a first centerline of said frame;

a press center on said slide;

said press center aligned with said first centerline and said frame;

only a first and a second guide member on said press machine;

a line between said first and said second guide member passing through said press center along a common centerline;

said drive mechanism operating said slide along said press center;

said slide and said frame symmetrical about said press center and said first centerline; and said frame being continuous and symmetrical about said first centerline whereby said frame resists a rotational force during a pressing operation and eliminates an operational gapping risk.

4. A press machine, according to claim 3, further comprising:

a first and a second side member on said press machine;

said first and second side members disposed symmetrical about a second centerline of said frame;

a crown member in said frame joining said first and second side members;

a drive mechanism holding section in said frame;

said crown member and a drive mechanism holding section supporting said drive mechanism;

a bed member; and said bed member connecting said first and second side members below said slide whereby said first and said second side member rigidly joined and said frame is increased in strength and rigidity thereby minimizing an operational gapping and increasing a pressing precision.

5. A press machine, according to claim 4, further comprising:

each said first and second guide member disposed symmetrical about said press center and said first centerline;

each said first and said second guide members supporting said slide;

at least a first liner member in each said first and second guide members;

a first and a second slide side gib on said slide;

each said first and second slide side gib in guiding contact with each said first liner on each respective said first and second members; and said first and second members and each said first liner engaging said slide and allowing said slide to operate in said press machine, whereby operational gapping is prevented and said pressing precision is improved.

6. A press machine, according to claim 5, further comprising:

a drive shaft in said drive mechanism;

said slide having a top and a bottom dead center position;

said drive shaft rotatably disposed on said frame;

a gear section on said drive shaft operable joined to said flywheel;

a main gear rotatably disposed on said frame;

said main gear meshing with said gear section;

a crank shaft rotatably disposed on said frame;

an eccentric section on said crank shaft;

a connecting rod operably coupling said crank shaft to said slide;

a first link fixed to a first end of said crank shaft;

said first link perpendicular to said crank shaft;

a second link operably connecting said first link to said main gear;

a first angle operably defined between said first and second link whereby said first angle is at a maximum at said bottom dead center position and at a minimum at said top dead center position; and a rotation axis of said main gear and a rotation axis of said crank shaft are eccentric along a common center line, whereby a speed of said slide is at a minimum at said bottom dead center and a maximum at said top dead center position thereby increasing a pressing force at said bottom dead center position.

7. A press machine, comprising:

a frame;

a flywheel;

a drive mechanism;

a drive shaft in said drive mechanism and rotatably disposed on said frame;

a gear section on said drive shaft operable joined to said flywheel;

a main gear rotatably disposed on said frame and meshing with said gear section;

a slide in said frame having a top and a bottom dead center position and operating along a first centerline of said frame;

a press center on said slide and aligned with said first centerline and said frame;

a first and a second guide member on said press machine;

a line between said first and said second guide member passing through said press center;

a crank shaft rotatably disposed on said frame;

an eccentric section on said crank shaft;

a connecting, rod operably coupling said crank shaft to said slide;

a first link fixed to a first end of said crank shaft and perpendicular to said crank shaft;

a second link operably connecting said first link to said main gear;

a first angle operably defined between said first and second link whereby said first angle is at a maximum at said bottom dead center position and at a minimum at said top dead center position;

a rotation axis of said main gear and a rotation axis of said crank shaft are eccentric along a common center line, whereby a speed of said slide is at a minimum at said bottom dead center and a maximum at said top dead center position thereby increasing a pressing force at said bottom dead center position;

said drive mechanism operating said slide along said press center;

said slide and said frame symmetrical about said press center and said first centerline; and said frame being continuous and symmetrical about said first centerline whereby said frame resists a rotational force during a pressing operation and eliminates an operational gapping risk.

* * * * *